US006117489A

United States Patent [19]

Ohkawa et al.

[11] Patent Number: 6,117,489

[45] **Date of Patent: *Sep. 12, 2000**

[54] MICROPOROUS SHEET, SUBSTRATE FOR ARTIFICIAL LEATHER USING SAID SHEET, AND PROCESS FOR PRODUCTION OF SAID SHEET

[75] Inventors: Nobuo Ohkawa, Osaka; Yoshiyuki Suzuki; Kunihiko Sasaki, both of Ooda, all of Japan

[73] Assignee: Teijin Limited, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/707,389

[22] Filed: Sep. 4, 1996

[30] Foreign Application Priority Data

Sep. 7, 1995 [JP] Japan ..... 7-230398

[51] Int. Cl.[7] ..... B32B 5/18

[52] U.S. Cl. ..... 427/331; 442/63; 442/77; 442/168; 442/170; 428/315.5; 428/904

[58] Field of Search ..... 442/77, 170, 168, 442/387, 415, 63, 104; 428/904, 315.5; 427/331

[56] References Cited

U.S. PATENT DOCUMENTS

| | | |
|---|---|---|
| 3,549,475 | 12/1970 | Hefley et al. . |
| 3,811,923 | 5/1974 | Hammer et al. . |
| 3,853,608 | 12/1974 | Hammer et al. . |
| 3,961,107 | 6/1976 | Hammer et al. . |

FOREIGN PATENT DOCUMENTS

| | | |
|---|---|---|
| 47-9839 | 5/1972 | Japan . |
| 48-31955 | 10/1973 | Japan . |

*Primary Examiner*—Elizabeth M. Cole
*Attorney, Agent, or Firm*—Wenderoth, Lind & Ponack, L.L.P.

[57] ABSTRACT

A microporous sheet suitably used as a substrate for artificial leather for its good balance in properties such as softness, abrasion resistance and the like, obtained by impregnating a non-woven fabric with an elastic polymer and then coagulating the impregnated polymer, said non-woven fabric being a blend of (a) an aromatic polyester fiber (fiber A) and (b) a polyolefin or aliphatic polyamide fiber (fiber B), which sheet is scattered with portions where the fiber A is surrounded by the elastic polymer in a bonded state and portions where the fiber B is surrounded by the elastic polymer in a not-bonded state.

3 Claims, No Drawings

MICROPOROUS SHEET, SUBSTRATE FOR ARTIFICIAL LEATHER USING SAID SHEET, AND PROCESS FOR PRODUCTION OF SAID SHEET

BACKGROUND OF THE INVENTION

1. Field of the Invention

The present invention relates to a microporous sheet, particularly a substrate for artificial leather; and to a process for production thereof. More specifically, the present invention relates to a microporous sheet which is obtained by impregnating a non-woven fabric with an elastic polymer and which is capable of controlling properties such as softness, abrasion resistance, tensile strength, tear strength and the like easily and appropriately to a desired extent depending on the purpose and application; and to a process for production of the microporous sheet. The microporous sheet of the present invention can be favorably used as a substrate for artificial leather.

2. Prior Art

In general, that substrates for artificial leather which can be made into a full-grain type artificial leather by coating a high polymer on a surface of the substrate or can be made into a suede type artificial leather or a nubuck type artificial leather by grinding the surface of the substrate, are produced by impregnating a woven fabric, a knit fabric or a non-woven fabric as a base fabric with a high polymer, particularly by impregnating a non-woven fabric with an elastic polymer (e.g. a polyurethane) in view of the strength and durability of the resulting substrate. In production of a microporous sheet suitable as such a substrate for artificial leather, however, impregnation of a fibrous base (e.g. a non-woven fabric) with a solution of an elastic polymer dissolved in an organic polar solvent such as dimethylformamide is followed by coagulation of the polymer of the impregnated solution in water, which results in adhesion of the elastic polymer to the fiber of the fabric and gives a natural leather substitute which is difficult to elongate and has abrasion resistance but is hard, and consequently has limited applications. Therefore, measures have been taken in the industry to prevent the adhesion of the elastic polymer to the fiber the fabric. For example, Japanese Kokai (Laid-Open) Patent Application No. 9839/1972 corresponding to U.S. Pat. No. 3,811,923 discloses a method which comprises applying, on the fiber of the fabric, an agent such as a silicone and the like, having a releasing effect on an elastic polymer, prior to the impregnation of the fiber with an elastic polymer. In this method, when the solvent used in the impregnation solution containing the elastic polymer is water, the adhesion of the elastic polymer to the fiber is prevented so that the fiber can have high freedom and a soft microporous sheet suitable as a substrate for artificial leather can be obtained. But, when the solvent is an organic polar solvent (e.g. dimethylformamide), the effect of the release agent is small and it is impossible to obtain a soft microporous sheet. Furthermore, when the fiber is covered with an agent having a releasing effect such as a silicone, a soft microporous sheet can be obtained because the elastic polymer does not adhere to the fiber, as mentioned above, but disadvantages are also increased that the resulting fabric is easy to elongate due to reduction in friction coefficient between fibers, has reduced abrasion resistance, and the like.

The method for production of a microporous sheet so as to allow no adhesion between polymeric polymer and fiber, includes also a method as described in, for example, Japanese Patent Publication No. 31955/1973, which comprises applying, on a surface of a fiber, a polymer (e.g. a polyvinyl alcohol) which is water-soluble but insoluble in dimethylformamide, impregnating the resulting fiber with a solution of a polyurethane dissolved in dimethylformamide, coagulating the polyurethane of the impregnated solution in water, and removing the polyvinyl alcohol by water washing. In this method, the adhesion between the polyurethane and the fiber can be prevented so that the fiber can have high freedom and a soft substrate for artificial leather can be obtained. In this case as well, however, while softness can be obtained, disadvantages appear that it is easy to elongate, has reduced abrasion resistance, and the like. That is, when the polyurethane and the fiber are completely bonded to each other, the fabric can have advantages that it has excellent abrasion resistance, is difficult to elongate, and the like, but has disadvantages that it is hard, has reduced tear strength, and the like. Conversely, when the polyurethane and the fiber are not completely bonded to each other, the fabric can have softness but has reduced abrasion resistance, and becomes easy to elongate.

In recent years, artificial leathers have gained wide acceptance in applications such as shoes, balls, furnitures, garments, gloves and other sundry goods. The property requirements for artificial leather vary depending upon the application and the kind of the fabrication. In order to produce artificial leathers well suited for wide applications or fabrication methods, the techniques used heretofore have a limitation.

Hence, the present inventors made extensive studies in order to provide a microporous sheet suitable as a substrate for artificial leather, in which sheet the proportions and densities of (a) portions where a fiber of the non-woven fabric and an elastic polymer are bonded (or adhered) to each other and (b) portions where a fiber and an elastic polymer are not bonded (or adhered) to each other can be easily controlled so as to meet the application of the microporous sheet and the fabrication; and to provide a process for production of the microporous sheet.

As a result, the present inventors have found that when a specific surfactant is dissolved in a solution of an elastic polymer to impregnate a non-woven fabric with the resulting solution and the polymer of the impregnated solution is coagulated in water, the fiber of the fabric and the elastic polymer are bonded or not bonded to each other depending upon the kind of the polymer impregnated into the fiber.

Thus, the present inventors have found that by forming a non-woven fabric from at least two kinds of fibers and further by changing the proportions of the different fibers in the non-woven fabric and impregnating the non-woven fabric with an elastic polymer solution containing a specific surfactant, there can be obtained a microporous sheet which has (a) portions where the fiber and the elastic polymer are bonded to each other and (b) portions where the fiber and the elastic polymer are not bonded to each other, in desirably controlled proportions and which has a desirably controlled balance in softness, abrasion resistance and strength. The present invention has been completed based on the above finding.

According to the present invention there is provided a microporous sheet obtained by impregnating a non-woven fabric with an elastic polymer solution and then coagulating the polymer, wherein (1) said non-woven fabric is a blend of (a) an aromatic polyester fiber (fiber A) and (b) a polyolefin or polyamide fiber (fiber B), and (2) the microporous sheet is (i) scattered with the portions where the fiber A is surrounded by the elastic polymer in a bonded state and the portions where the fiber B is surrounded by the elastic polymer in a not-bonded state, and has (ii) a softness of 0.5 to 6.0 and (iii) an abrasion resistance of 1,500 to 8,000.

According to the present invention there is further provided a process for producing a microporous sheet by impregnating a non-woven fabric with a solution of an elastic polymer dissolved in an organic polar solvent and then coagulating the polymer of the impregnated solution in a coagulation bath composed mainly of water, wherein the non-woven fabric is a blend of a polyester fiber (fiber A) and a polyolefin or nylon fiber (fiber B) and the organic polar solution is a solution containing 0.1 to 10 parts by weight, per 100 parts by weight (as solid content) of the elastic polymer, of a water-dispersible or water-soluble surfactant having a silicone segment as a hydrophobic group.

DETAILED DESCRIPTION OF THE INVENTION

The microporous sheet and process for production thereof both according to the present invention are hereinafter described in detail.

The fiber constituting the non-woven fabric used in the present invention is a blend of two kinds of fibers, i.e. a fiber A and a fiber B.

The fiber A is an aromatic polyester and the fiber B is a polyolefin or polyamide fiber.

In the following description, "a water-dispersible or water-soluble surfactant having a silicone segment as a hydrophobic group" used in an organic polar solvent solution is abbreviated to "a silicone-based surfactant" sometimes.

The fiber A has such a surface property that when the above-mentioned elastic polymer is coagulated in a coagulation bath solution, the fiber A and the coagulated elastic polymer are bonded to each other regardless of whether or not the impregnation solution contains the silicone-based surfactant, and is typically represented by an aromatic polyester fiber. Specific examples of the aromatic polyester fiber are a polyethylene terephthalate, a polybutylene terephthalate, a polyhexamethylene terephthalate, a polyethylene isophthalate, a polyethylene-2,6-naphthalate or copolymers thereof. The mechanism is not clarified yet in which the fiber A, unlike the fiber B, adheres to the impregnated elastic polymer despite the presence of the silicone-based surfactant in the impregnation solution. The mechanism, however, is presumed to be as follows. That is, when the organic polar solvent solution containing the elastic polymer, impregnated into the fiber A, is immersed in a coagulation bath solution composed mainly of water, the organic polar solvent in the solution is eluted out in the coagulation bath solution and the elastic polymer is coagulated, and at this time, the silicone-based surfactant coordinates on the elastic polymer surface. Although the surface of the elastic polymer has water-repellency owing to the hydrophobic polysiloxane segment of the coordinated silicone-based surfactant, it is assumed that the elastic polymer and the fiber A are bonded to each other because the fiber A has high affinity with the polysiloxane. The fiber A is preferably a fiber from a polyethylene terephthalate or a copolymer containing ethylene terephthalate units in an amount of at least 80 mole %, preferably at least 85 mole % of the whole recurring units.

The fiber B has such a surface property that when the elastic polymer is coagulated in a coagulation bath solution, the fiber B and the elastic polymer are not adhered to each other owing to the action of the silicone-based surfactant dissolved in the impregnation solution. As a result, the fiber B is surrounded by the elastic polymer in a not-adhered state.

The polymer constituting the fiber B includes, for example, polyolefins such as polypropylene, polyethylene and the like and aliphatic polyamides such as 6 nylon, 6/6 nylon, 6/10 nylon, 10/9 nylon, 10/10 nylon, 11 nylon, 12 nylon and the like. The mechanism is not clarified yet in which the fiber B and the impregnated elastic polymer are not bonded to each other in the presence of the silicone-based surfactant present in the impregnation solution. The mechanism, however, is presumed to be as follows. That is, when the organic polar solvent solution containing the elastic polymer, impregnated into the fiber B, is immersed in the coagulation bath solution composed mainly of water, the organic polar solvent in the solution is eluted out in the coagulation bath solution and the elastic polymer is coagulated, and at this time, the silicone-based surfactant coordinates on the elastic polymer. Consequently, the surface of the elastic polymer has water-repellency owing to the hydrophobic polysiloxane segment of the coordinated silicone-based surfactant, the contact between the fiber B and the elastic polymer is prevented via a water-organic polar solvent mixture present between the fiber B and the elastic polymer so that the fiber B and the elastic polymer are not bonded to each other.

The polymer constituting the fiber B is preferably a polypropylene or a polyethylene when it is a polyolefin, and preferably 6 nylon or 6/6 nylon when it is a nylon. The fiber B is particularly preferably a polyolefin fiber.

In the present invention, by impregnating a non-woven fabric formed of a fiber A and a fiber B with an organic polar solvent solution of an elastic polymer, which contains a silicone-based surfactant, and subjecting the resulting fabric to a coagulation treatment in water, the fiber B has portions where the fiber B is surrounded by the elastic polymer in a not-bonded state, while the fiber A has portions where the fiber A is surrounded by the elastic polymer in a bonded state; as a result, a microporous sheet is formed in which said two kinds of portions are present randomly. In general, a microporous sheet wherein the constituent fiber is surrounded by an elastic polymer in a not-bonded state, has high fiber freedom and consequently, has high softness, but tends to be easy to elongate and have reduced abrasion resistance. In contrast, a microporous sheet wherein the constituent fiber is surrounded by an elastic polymer in a bonded state has no fiber freedom and consequently, is difficult to elongate and has high abrasion resistance, while it is very hard. Thus, in the present invention, by controlling the mixing proportions of the fiber A and the fiber B, the proportions of the not-bonded structure present between elastic polymer and fiber and the bonded structure present between elastic polymer and fiber can be controlled as desired and there can be obtained a microporous sheet which varies widely as desired in balance between softness, elongation stress, abrasion resistance, etc. In the present invention, the mixing proportions of the fiber A and the fiber B can be selected as desired, while a non-woven fabric obtained by blending the fiber A and the fiber B in a weight ratio of 70:30 to 5:95 is preferred in view of the softness of the microporous sheet obtained. The mixing proportions of the fiber A and the fiber B are particularly preferably 60:40 to 10:90 by weight.

The non-woven fabric used in the present invention has no particular restriction as to its form as long as the fiber constituting the fabric is a blend of the fiber A and the fiber B. However, the fiber A and the fiber B are preferably blended uniformly throughout the whole portion of the fabric. By impregnating an elastic polymer into the non-woven fabric wherein the fiber A and the fiber B are uniformly blended, there can be obtained a microporous sheet wherein two kinds of (a) the portions where the fiber A is surrounded by the elastic polymer in a bonded state and (b) the portions where the fiber B is surrounded by the elastic polymer in a not-bonded state are present scatteringly and uniformly.

Specific examples of the form of the non-woven fabric of the present invention include (i) a non-woven fabric obtained by uniformly carding short fibers by the use of, for example, a carding machine, laminating the carded short fibers to form a web and subjecting the web to an intertwining treatment by needle punching or by contact with a jet liquid flow, (ii) a non-woven fabric obtained by laminating a long-fiber non-woven fabric and the above web and subjecting the laminate to an intertwining treatment, (iii) a non-woven fabric obtained by laminating a non-woven fabric made by the melt-blow method and the above web and subjecting the laminate to an intertwining treatment, (iv) a non-woven fabric obtained by laminating a non-woven fabric made by the wet method and the above web and subjecting the laminate to an intertwining treatment, (v) a non-woven fabric obtained by laminating at least two kinds of long-fiber non-woven fabrics and subjecting the laminate to an intertwining treatment and (vi) a non-woven fabric obtained by making a splittable composite fiber (which has an alternate arrangement of two kinds of polymers constituting the fibers A and B) into the above-mentioned carding web and subjecting the web to an intertwining treatment by needle punching or by contact with a jet liquid flow.

The forms of the non-woven fabric may be a blend of two kinds of fibers, or a laminate of at least two kinds of fiber layers. Desirably, a blending means, a lamination means and an intertwining means are appropriately combined so as to give a non-woven fabric in which the fiber A and the fiber B are blended uniformly.

In order to obtain a satisfactory microporous sheet for use as a substrate for artificial leather, the form of the non-woven fabric is suitably a non-woven fabric (i) mentioned above, obtained by using two kinds of short fibers.

The fiber A and the fiber B constituting the non-woven fabric may be a long fiber or a short fiber, while either or both of them is(are) preferably a short fiber. Particularly preferably, each of them are a short fiber. When either of them is a long fiber, the fiber A is preferably a long fiber.

The appropriate fineness of the fiber A is 0.05 to 100 denier, preferably 0.1 to 5.0 denier. The appropriate fineness of the fiber B is 0.05 to 100 denier, preferably 0.1 to 5.0 denier. The fiber length, when the fiber is a short fiber, is generally 20 to 200 mm, preferably 30 to 80 mm although it varies depending upon the form of the non-woven fabric constituted by the fiber. In this case, the short fiber includes a short fiber obtained by uniform-length cutting and a short fiber obtained by nonuniform-length cutting.

The elastic polymer used in the present invention may be any elastic polymer ordinarily used in a substrate for artificial leather, and is preferably a polyurethane.

The polyurethane is suitably a polyurethane used in a substrate for artificial leather, i.e. a known thermoplastic polyurethane obtained by polymerization of an organic diisocyanate, a high diol and a chain extender. The organic diisocyanate includes aliphatic, alicyclic or aromatic diisocyanates having two isocyanate groups in the molecule; particularly, 4,4'-diphenylmethane diisocyanate, p-phenylene diisocyanate, toluylene diisocyanate, 1,5-naphthalene diisocyanate, xylylene diisocyanate, hexamethylene diisocyanate, isophorone diisocyanate, 4,4'-dicyclohexylmethane diisocyanate and the like. The high diol includes, for example, at least one polymer glycol having an average molecular weight of 500 to 4,000, selected from a polyester glycol obtained by condensation polymerization between a glycol and aliphatic dicarboxylic acid, a polylacetone glycol obtained by ring-opening polymerization of lactone, an aliphatic or aromatic polycarbonate glycol and a polyether glycol. The chain extender includes diols having 500 or less molecular weight and two hydrogen atoms capable of reacting with isocyanate, such as ethylene glycol, 1,4-butanediol, hexamethylene glycol, xylylene glycol, cyclohexanediol, neopentyl glycol and the like.

The elastic polymer, particularly the polyurethane, having a concentration of 6 to 20% by weight is used in a form of a solution dissolved in an organic polar solvent. A microporous sheet is formed by the wet method, i.e., a method to impregnate a non-woven fabric with the above solution. That is, a non-woven fabric is impregnated with the solution, and the resulting fabric is immersed in a coagulation bath composed mainly of water to extract the organic polar solvent, so that the elastic polymer is coagulated to form a microporous sheet.

The organic polar solvent used for dissolving the elastic polymer includes, for example, dimethylformamide, diethylformamide, dimethylacetamide, dimethylsulfoamide, tetrahydrofuran and dioxane. Of these, dimethylformamide is preferred.

In obtaining the microporous sheet of the present invention, a water-dispersible or water-soluble silicone-based surfactant having a silicone segment as a hydrophobic group is added to the organic polar solvent solution containing an elastic polymer, to be impregnated into the non-woven fabric. The silicone-based surfactant contains the silicone segment in an amount of preferably 10 to 90% by weight. The silicone-based surfactant preferably has, in the molecule, a polysiloxane unit as a hydrophobic group and a unit composed mainly of a polyoxyalkylene chain as a hydrophilic group. The surfactant can be obtained, for example, by adding an alkylene oxide (e.g. ethylene oxide) as a hydrophilic group to a polysiloxane having a group reactive with an alkylene oxide (e.g. ethylene oxide) at the molecular terminal(s) or in the molecule. The surfactant can also be obtained by reacting a polysiloxane having, at the molecular terminal(s) or in the molecule, a group reactive with isocyanate, with a polyvalent organic isocyanate and then reacting the reaction product with a polyoxyalkylene glycol composed mainly of a polyoxyethylene glycol.

The silicone-based surfactant of the present invention suitably essentially consists of a silicone segment and a polyalkylene oxide segment. Particularly suitable is a silicone-based surfactant containing a silicone segment in an amount of 10 to 90% by weight, preferably 20 to 80% by weight. The polyalkylene oxide is preferably a polyethylene oxide, a polypropylene oxide, a polybutylene oxide or copolymers thereof. Particularly preferable is a a polyethylene oxide or a polyalkylene oxide composed mainly of a polyethylene oxide.

The silicone-based surfactant preferably has a molecular weight of 1,200 to 120,000, and the polysiloxane component in its molecule preferably has a molecular weight of 400 to 25,000. When the molecular weight of the polysiloxane component is less than 400 or when the molecular weight of the silicone-based surfactant is less than 1,200, the silicone-based surfactant is liable to ooze out from the coagulated elastic polymer. When the molecular weight of the surfactant is more than 120,000, it is difficult to form a not-bonded structure between the fiber B and the elastic polymer without deteriorating the properties of the elastic polymer, or to dissolve the surfactant into the organic polar solvent.

In the present invention, the amount of the silicone-based surfactant added into the organic polar solvent solution of the elastic polymer is 0.1 to 10 parts by weight, preferably 0.5 to 3.0 parts by weight per 100 parts by weight (as solid content) of the elastic polymer. When the amount of the silicone-based surfactant added is less than 0.1 part by weight, it is difficult to form a not-bonded structure between the fiber B and the elastic polymer when the fabric impregnated with the solution is immersed in water to coagulate the elastic polymer. When the amount of the silicone-based surfactant added is more than 10 parts by weight, the silicone-based surfactant is liable to ooze out from the coagulated elastic polymer, which invites various troubles in a later processing to produce an artificial leather or in a fabrication to produce a product (e.g. shoes or balls) from the artificial leather.

The thus-obtained microporous sheet of the present invention has excellent properties for use as a substrate for artificial leather, and the properties can be controlled in a wide range as desired. Of the properties, the softness is 0.5 to 6.0, preferably 0.6 to 5.0, more preferably 0.7 to 3.0; and the abrasion resistance is 1,500 to 8,000, preferably 1,500 to 5,000.

Further, the microporous sheet of the present invention is desired to have a 20% elongation stress of 1.0 to 8.0, preferably 2.0 to 6.0 and a tear strength of 3 to 8, preferably 4 to 7.

The microporous sheet of the present invention has an apparent specific gravity of 0.2 to 6.0 g/cm$^3$, preferably 0.3 to 5.0 g/cm$^3$, and is relatively light, and has a soft hand.

The microporous sheet of the present invention has adequate softness and abrasion resistance in good balance, as mentioned previously. The reason is presumed to be that the sheet uses a non-woven fabric which is a blend of two types of fibers and that the two types of fibers are surrounded by an elastic polymer in different states.

That is, the fiber A is surrounded by the elastic polymer generally in a bonded state while the fiber B is surrounded by the polymer generally in a not-bonded state and has more freedom relative to the polymer than the fiber A, and hence, the present microporous sheet is presumed to have properties such as mentioned above.

In the present microporous sheet, the portions where the fiber A is surrounded by the elastic polymer in a bonded state and the portions where the fiber B is surrounded by the polymer in a not-bonded state, are present scatteringly and the proportions of the above two kinds of portions can be varied as desired. Therefore, a microporous sheet having softness and other properties as desired depending upon the purpose and application can be obtained. The bonded or not-bonded state in which the fiber is surrounded by the elastic polymer, can be easily confirmed by observing the cross section of the microporous sheet through an electron microscope.

The not-bonded (or not adhered) state refers to a state in which the fiber is surrounded by the elastic polymer via a gap present at the interface between the fiber and the polymer, and can be observed by the photograph taken by the electron microscope. On the other hand, the bonded state refers to a state in which there is no interfacial gap between the fiber and the polymer.

The microporous sheet of the present invention can be used directly for various applications. For example, it can be used by itself as a substrate for artificial leather but can be used as a more practical substrate for artificial leather by forming an elastic polymer layer on one or both of its sides. The formation of the elastic polymer layer can be conducted by coating the surface of the present microporous sheet with the previously-mentioned elastic polymer solution (this solution does not necessarily contain a silicone-based surfactant) and then drying the coated solution, or by wet coagulation followed by drying, or by lamination using a release paper. The appropriate thickness of the elastic polymer layer formed on the present microporous sheet is usually 20 to 500 $\mu$m, preferably 30 to 300 $\mu$m.

EXAMPLES

The present invention is hereinafter described specifically by way of Examples. In the Examples, "part(s)" and "%" refer to part(s) by weight and % by weight, respectively, and properties were measured by the following methods.

1. Softness

A test piece of 25 mm (wide)×90 mm (long) was prepared. One end portion (25 mm wide and 20 mm long) of the test piece was fixed by a holder so that the test piece was kept vertically with the fixed portion being at the lowest position. Then, the test piece was bent by applying a pressure to the other end and the holder was slid so that the center of a test piece width 20 mm distant from the other end of the test piece came in contact with the lower end of the measurement section of a U-gauge, located at a height 20 mm above the holder. Thereafter, the test piece and the holder were placed in that state for 5 minutes, and the stress of the test piece was read by a recorder of the measurement section. The stress was then converted to a stress per cm of test piece width and expressed as softness (a bending resistance) having a unit of g/cm.

2. Elongation

Stress at 20% elongation was measured by a method according to JIS K 6550 (corresponding to ASTM D2209). It was converted to a value per cm (width) and expressed as 20% elongation stress (kg/cm).

3. Abrasion resistance

Measured by a method according to the method C (Taber method) of JIS L 1096 (corresponding to ASTM D4060). H 22 was used as the abrasion test wheel. Abrasion resistance was expressed by the times up to the whole layer was abraded.

4. Tear strength

Measured by a method according to JIS K 6550 (tear strength)(corresponding to ASTM D4704) and expressed in a unit of kg.

Example 1

A polyethylene terephthalate fiber having 2.0 de.(cut length: 51 mm; number of crimps: 13/25.4 mm) and a polypropylene fiber having 2.0 de. (cut length: 50 mm; number of crimps: 13/25.4 mm) were blended at a weight ratio of 30:70. The blend was made into a laid web using a card and a cross layer. The laid web was subjected to punching (depth: 7 mm, density: 700/cm$^2$) with a needle loom equipped with No.40 needles having regular barb, to obtain an intertwined web. The intertwined web was pressurized by a mirror-surface metal roll having a surface temperature of 130° C. to form a non-woven fabric-1 having a thickness of 1.0 mm and a weight of 230 g/m$^2$.

Separately, 4,4'-diphenylmethane diisocyanate was polymerized with polytetramethylene glycol having a molecular weight of 2,000, polybutylene adipate with a hydroxyl group at each terminal, having a molecular weight of 1,700 and diethylene glycol in a dimethylformamide solution, to obtain a dimethylformamide solution containing a polyurethane in a concentration of 12%. To this solution was added, as a silicone-based additive, a silicone oil added with ethylene oxide [G-10 (trade name), a product of Matsumoto Yushi-Seiyaku Co., Ltd., silicone segment: 56%, ethylene oxide segment: 46%, average molecular weight: about 4,000] in an amount of 1.0 part per 100 parts (as solid content) of the polyurethane, to form an impregnation solution-1. The non-woven fabric-1 was impregnated with the impregnation solution-1, and an excess of the impregnation solution-1 on the both surfaces of the non-woven fabric-1 was removed. The resulting material was immersed in an aqueous solution containing 10% of dimethylformamide, to coagulate the polyurethane, followed by water washing and drying, to produce an artificial leather substrate-1.

The artificial leather substrate-1 had a thickness of 1.0 mm and a weight of 405 g/m$^2$, and showed softness, elongation, abrasion resistance and tear strength as shown in Table 1. Thus, the substrate-1 had a good balance in properties for use as an artificial leather for shoes. The sectional structure of the substrate-1 was observed by the use of an electron microscope, which confirmed that in the substrate-1, the portions where fibers were bonded by the polyurethane and the portions where the polyurethane was present in a not-bonded state between fibers, were present in a mixed state.

Comparative Example 1

The non-woven fabric 1 formed in Example 1 was used. There was also used an impregnation solution-2 obtained by adding, to the dimethylformamide solution containing a polyurethane in a concentration of 12%, obtained in Example 1, an ethylene oxide (12 moles)-added higher aliphatic alcohol (Nonipol SDH 90, a product of Sanyo Chemical Industries, Ltd.) in an amount of 1.0 part per 100 parts (as solid content) of the polyurethane. An artificial leather substrate-2 was produced according to the same procedure as in Example 1.

The substrate-2 had a thickness of 1.0 mm and a weight of 400 g/m$^2$, and was very hard. Further, other properties were not balanced for use as an artificial leather. The sectional structure of the substrate-2 was observed by the use of an electron microscope. As a result, the presence of the portions where fibers were bonded by the polyurethane, was confirmed; however, the presence of the portions where the polyurethane was present in a not-bonded state between fibers, was not confirmed.

Comparative Example 2

A polyethylene terephthalate fiber having 2.0 de. (cut length: 51 mm; number of crimps: 13/25.4 mm) and a polypropylene fiber having 2.0 de. (cut length: 50 mm; number of crimps: 13/25.4 mm) were blended at a weight ratio of 90:10. The blend was made into a laid web using a card and a cross layer. The laid web was subjected to punching (depth: 7 mm, density: 700/cm$^2$) with a needle loom equipped with No. 40 needles having regular barb, to obtain an intertwined web. The intertwined web was pressurized by a mirror-surface metal roll having a surface temperature of 130° C. to form a non-woven fabric-2 having a thickness of 1.0 mm and a weight of 230 g/m$^2$.

The non-woven fabric-2 was impregnated with the impregnation solution-1 containing a silicone-based additive, prepared in Example 1. The subsequent operation was conducted in the same manner as in Example 1 to produce an artificial leather substrate-3. The substrate-3 had a thickness of 1.0 mm and a weight of 405 g/m$^2$, and was very hard. Further, other properties were not balanced for use as an artificial leather. The sectional structure of the substrate-3 was observed by the use of an electron microscope. As a result, the presence of the portions where fibers were bonded by the polyurethane was confirmed; however, the presence of the portions where the polyurethane was present in a not-bonded state between fibers was very few and hardly confirmed.

Example 2

A polyethylene terephthalate fiber having 2.0 de. (cut length: 51 mm; number of crimps: 13/25.4 mm) was made into a laid web by the use of a card and a cross layer. Separately, a polypropylene fiber having 2.0 de. (cut length: 50 mm; number of crimps: 13/25.4 mm) was made into a laid web by the use of a card and a cross layer. The latter web was laminated on the former web and the laminate was subjected to punching (depth: 7 mm, density: 700/cm$^2$) with a needle loom equipped with No.40 needles having regular barb, to obtain an intertwined web. The intertwined web was pressurized by a mirror-surface metal roll having a surface temperature of 130° C., to obtain a non-woven fabric-3 having a thickness of 1.0 mm and a weight of 230 g/m$^2$. The fabric-3 was impregnated with the impregnation solution-1 containing a silicone-based additive, obtained in Example 1. The subsequent operation was the same as in Example 1 to produce an artificial leather substrate-4.

The artificial leather substrate-4 had a thickness of 1.0 mm and a weight of 405 g/m$^2$, and showed softness, elongation property, abrasion resistance and tear strength as shown in Table 1. Thus, the substrate-4 had a good balance in properties for use as an artificial leather for shoes. The sectional structure of the substrate-4 was observed by the use of an electron microscope, which confirmed that in the upper layer containing the abundant polypropylene fiber, the polyurethane was present between fibers in a not-bonded state and in the lower layer having the abundant polyester fiber, the polyurethane and the fiber were present in a bonded state.

Example 3

A polyethylene terephthalate fiber having 2.0 de.(cut length: 51 mm; number of crimps: 13/25.4 mm) and a 6-nylon fiber having 2.0 de.(cut length: 50 mm; number of crimps: 14/25.4 mm) were blended at a weight ratio of 50:50. The blend was made into a laid web using a card and a cross layer. The laid web was subjected to punching (depth: 7 mm, density: 700/cm$^2$) with a needle loom equipped with No. 40 needles having regular barb, to obtain an intertwined web. The intertwined web was pressurized by a mirror-surface metal roll having a surface temperature of 130° C. to form a non-woven fabric-4 having a thickness of 1.0 mm and a weight of 230 g/m$^2$.

The non-woven fabric-4 was impregnated with the impregnation solution-1 containing a silicone-based additive, obtained in Example 1. The subsequent operation was the same as in Example 1 to produce an artificial leather substrate-5. The artificial leather substrate-5 had a thickness of 1.0 mm and a weight of 400 g/m$^2$, and showed softness, elongation property, abrasion resistance and tear strength as shown in Table 1. Thus, the substrate-5 had a good balance in properties for use as an artificial leather for shoes. The sectional structure of the substrate-5 was observed by the use of an electron microscope, which confirmed that in the substrate-5, the portions where fibers were bonded by the polyurethane and the portions where the polyurethane was present between fibers in a not-bonded state, were present in a mixed state.

Comparative Example 3

The non-woven fabric-1 obtained in Example 1 was treated with an aqueous dispersion containing 1% of a reactive silicone (H silicone oil) (Gelanex SH, a product of Matsumoto Yushi-Seiyaku Co., Ltd.), followed by drying, to prepare a non-woven fabric-5. The fabric-5 was impregnated with the impregnation solution-1 containing a silicone-based additive, obtained in Example 1. The subsequent operation was the same as in Example 1 to produce an artificial leather substrate-6.

The substrate-6 had a thickness of 1.0 mm and a weight of 400 g/m$^2$, and was very soft. However, other properties (e.g. it was liable to much elongate.) were not balanced for use as an artificial leather, as shown in Table 1. The sectional structure of the substrate-6 was observed by the use of an electron microscope. As a result, the portions where fibers were bonded by the polyurethane were not confirmed, while the portions where the polyurethane was present between fibers in a not-bonded state were confirmed.

Example 4

A polyethylene terephthalate fiber having 2.0 de.(cut length: 51 mm; number of crimps: 13/25.4 mm) and a polypropylene fiber having 2.0 de. (cut length: 50 mm; number of crimps: 13/25.4 mm) were blended at a weight ratio of 60:40. The blend was made into a laid web using a card and a cross layer. The laid web was subjected to punching (depth: 7 mm, density: 700/cm$^2$) with a needle loom equipped with No.40 needles having regular barb, to obtain an intertwined web. The intertwined web was pressurized by a mirror-surface metal roll having a surface temperature of 130° C. to form a non-woven fabric-5 having a thickness of 1.0 mm and a weight of 230 g/m$^2$.

Separately, to the dimethylformamide solution containing a polyurethane in a concentration of 12%, obtained in Example 1 was added a silicone-based additive, i.e. a silicone oil added with ethylene oxide [G-11 (trade name), a product of Matsumoto Yushi-Seiyaku Co., Ltd., silicone segment: 46%, ethylene oxide segment: 54%, average molecular weight: about 1,800] in an amount of 1.0 part per 100 parts (as solid content) of the polyurethane, to form an impregnation solution-3. The impregnation solution-3 was impregnated into the non-woven fabric-5, and the subsequent operation was conducted in the same manner as in Example 1 to produce an artificial leather substrate-7.

The artificial leather substrate-7 had a thickness of 1.0 mm and a weight of 400 g/m$^2$, and showed softness, elongation, abrasion resistance and tear strength as shown in Table 1. Thus, the substrate-7 had a good balance in properties for use as an artificial leather for shoes. The sectional structure of the substrate-7 was observed by the use of an electron microscope, which confirmed that in the substrate-7, the portions where fibers were bonded by the polyurethane and the portions where the polyurethane was present in a not-bonded state between fibers, were present in a mixed state.

Example 5

A polyethylene terephthalate fiber having 2.0 de.(cut length: 51 mm; number of crimps: 13/25.4 mm) and a polypropylene fiber having 2.0 de. (cut length: 50 mm; number of crimps: 13/25.4mm) were blended at a weight ratio of 20:80. The blend was made into a laid web using a card and a cross layer. The laid web was subjected to punching (depth: 7 mm, density: 700/cm$^2$) with a needle loom equipped with No. 40 needles having regular barb to obtain an intertwined web. The intertwined web was pressurized by a mirror-surface metal roll having a surface temperature of 130° C. to form a non-woven fabric-6 having a thickness of 1.0 mm and a weight of 230 g/m$^2$.

The fabric-6 was impregnated with the impregnation solution-3 containing a silicone-based additive, obtained in Example 4. The subsequent operation was the same as in Example 1 to produce an artificial leather substrate-8.

The artificial leather substrate-8 had a thickness of 1.0 mm and a weight of 405 g/m$^2$, and showed softness, elongation property, abrasion resistance and tear strength as shown in Table 1. Thus, the substrate-8 had a good balance in properties for use as an artificial leather for shoes. The sectional structure of the substrate-8 was observed by the use of an electron microscope, which confirmed that in the substrate 8, the portions where fibers were bonded by the polyurethane and the portions where the polyurethane was present between fibers in a not-bonded state, were present in a mixed state.

Example 6

A polyethylene terephthalate fiber having 2.0 de. (cut length: 51 mm, number of crimps: 13/25.4 mm) and a 6,6-nylon fiber having 2.0 de.(cut length: 38 mm, number of crimps: 13/25.4 mm) were blended at a weight ratio of 50:50. The blend was made into a laid web using a card and a cross layer. The laid web was subjected to punching (depth: 5 mm, density: 850/cm$^2$) with a needle loom equipped with No.40 needles having regular barb to obtain an intertwined web. The intertwined web was pressurized by a mirror-surface metal roll having a surface temperature of 130° C. to form a non-woven fabric-7 having a thickness of 1.0 mm and a weight of 230 g/m$^2$.

The non-woven fabric-7 was impregnated with the impregnation solution-3 obtained in Example 4. The subsequent operation was the same as in Example 1 to produce an artificial leather substrate-9.

The artificial leather substrate-9 had a thickness of 1.0 mm and a weight of 400 g/m$^2$, and showed softness, elongation property, abrasion resistance and tear strength as shown in Table 1. Thus, the substrate-9 had a good balance in properties for use as an artificial leather for shoes. The sectional structure of the substrate-9 was observed by the use of an electron microscope, which confirmed that in the substrate-9, the portions where fibers were bonded by the polyurethane and the portions where the polyurethane was present in a not-bonded state between fibers, were present in a mixed state.

Example 7

A polyethylene terephthalate fiber having 2.0 de.(cut length: 51 mm, number of crimps: 13/25.4 mm) and a polyethylene fiber having 1.5 de. (cut length: 50 mm, number of crimps: 14/25.4 mm) were blended at a weight ratio of 60:40. The blend was made into a laid web using a card and a cross layer. The laid web was subjected to punching (depth: 6 mm, density: 900/cm$^2$) with a needle loom equipped with No. 40 needles having regular barb to obtain an intertwined web. The intertwined web was pressurized by a mirror-surface metal roll having a surface temperature of 130° C. to form a non-woven fabric-8 having a thickness of 1.0 mm and a weight of 230 g/m$^2$.

The non-woven fabric-8 was impregnated with the impregnation solution-1 obtained in Example 1. The subsequent operation was the same as in Example 1 to produce an artificial leather substrate-10.

The artificial leather substrate-10 had a thickness of 1.0 mm and a weight of 400 g/m$^2$, and showed softness, elongation property, abrasion resistance and tear strength as shown in Table 1. Thus, the substrate-10 had a good balance in properties for use as an artificial leather for shoes. The sectional structure of the substrate-10 was observed by the use of an electron microscope, which confirmed that in the substrate-10, the portions where fibers were bonded by the polyurethane and the portions where the polyurethane was present in a not-bonded state between fibers, were present in a mixed state.

TABLE 1

| | | Softness | 20% elongation stress | Abrasion resistance | Tear strength |
|---|---|---|---|---|---|
| Natural leather (for shoes) | | 0.5–3.0 | 4.0–8.0 | 1,500< | 4< |
| Example 1 | Artificial leather substrate-1 | 1.2 | 5.3 | 2,100 | 5.6 |
| Comp. Example 1 | Artificial leather substrate-2 | 7.0 | 8.1 | 3,150 | 3.5 |
| Comp. Example 2 | Artificial leather substrate-3 | 7.3 | 8.6 | 3,200 | 3.2 |
| Example 2 | Artificial leather substrate-4 | 1.5 | 5.5 | 2,500 | 5.7 |
| Example 3 | Artificial leather substrate-5 | 1.0 | 5.7 | 2,300 | 5.9 |
| Comp. Example 3 | Artificial leather substrate-6 | 0.5 | 1.4 | 970 | 6.1 |

TABLE 1-continued

| | | Softness | 20% elongation stress | Abrasion resistance | Tear strength |
|---|---|---|---|---|---|
| Example 4 | Artificial leather substrate-7 | 1.1 | 4.9 | 2,400 | 5.2 |
| Example 5 | Artificial leather substrate-8 | 0.7 | 4.8 | 3,300 | 5.9 |
| Example 6 | Artificial leather substrate-9 | 0.9 | 5.1 | 2,700 | 5.7 |
| Example 7 | Artificial leather substrate-10 | 1.1 | 4.9 | 2,500 | 5.3 |

What is claimed is:

1. A process for producing a microporous sheet which comprises impregnating a non-woven fabric with a solution of a polyurethane dissolved in an organic polar solvent and coagulating the polyurethane of the impregnated solution in a coagulation bath composed mainly of water, wherein the non-woven fabric is a blend of a polyester fiber (fiber A) and a polyolefin or polyamide fiber (fiber B) and the solution contains 0.1 to 10 parts by weight, per 100 parts by weight (as solid content) of the polyurethane, of a water-dispersible or water-soluble surfactant having a hydrophilic group and silicone segment as a hydrophobic group, and wherein the surfactant contains a polyalkylene oxide segment and a silicone segment in a weight ratio of 10:90 to 90:10.

2. A process according to claim 1, wherein the weight ratio of the fiber A and the fiber B in the non-woven fabric is 70:30 to 5:95.

3. A process according to claim 1, wherein the fiber B is a polyolefin or nylon fiber.

* * * * *